US008873995B2

(12) United States Patent
Leemhuis

(10) Patent No.: US 8,873,995 B2
(45) Date of Patent: Oct. 28, 2014

(54) INPUT PORT FOR A COOLING SYSTEM OF AN IMAGING UNIT

(75) Inventor: James Richard Leemhuis, Lexington, KY (US)

(73) Assignee: Lexmark International, Inc. KY (US)

( * ) Notice: Subject to any disclaimer, the term of this patent is extended or adjusted under 35 U.S.C. 154(b) by 201 days.

(21) Appl. No.: 13/460,169

(22) Filed: Apr. 30, 2012

(65) Prior Publication Data

US 2013/0266337 A1 Oct. 10, 2013

Related U.S. Application Data

(60) Provisional application No. 61/620,420, filed on Apr. 4, 2012.

(51) Int. Cl.
*G03G 21/20* (2006.01)

(52) U.S. Cl.
USPC ..... 399/92; 399/94

(58) Field of Classification Search
CPC ..... G03G 21/206
USPC ..... 399/92, 94
See application file for complete search history.

(56) References Cited

U.S. PATENT DOCUMENTS

| | | | | |
|---|---|---|---|---|
| 6,937,830 | B2 * | 8/2005 | Satoh | 399/92 |
| 7,877,037 | B2 * | 1/2011 | Igarashi | 399/92 |
| 7,937,014 | B2 * | 5/2011 | Kawamata | 399/92 |
| 2011/0121510 | A1 * | 5/2011 | Tsuda et al. | 271/226 |
| 2011/0142481 | A1 * | 6/2011 | Kwak | 399/92 |
| 2011/0219572 | A1 * | 9/2011 | Conrad | 15/347 |

* cited by examiner

*Primary Examiner* — Sandra Brase
(74) *Attorney, Agent, or Firm* — William F. Esser

(57) ABSTRACT

An imaging unit of an imaging apparatus is provided including a developer unit for developing a toner and a cooling system. The cooling system includes an air distribution duct and a connecting segment. The connecting segment includes an air conduit attached to the air distribution duct and an air entry port disposed on the air conduit for connecting to the air supply line during installation of the imaging unit. A contacting surface of the air entry port is angled inwardly in two directions, relative to the air conduit, that are orthogonal to each other.

20 Claims, 9 Drawing Sheets

INPUT PORT FOR A COOLING SYSTEM OF AN IMAGING UNIT

CROSS REFERENCES TO RELATED APPLICATIONS

Pursuant to 35 U.S.C. §119, this application claims the benefit of the earlier filing date of Provisional Application Ser. No. 61/620,420, filed Apr. 4, 2012, entitled "Input Port for a Cooling System of an Imaging Unit," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Technical Field

The present disclosure relates to an imaging apparatus. More particularly, it relates to cooling an imaging unit of an electrophotographic imaging apparatus.

2. Description of the Related Art

The art of printing images with electrophotographic technology is relatively well-known. In the field of electrophotographic imaging, printing process speed has increased steadily with each new product. With increased speed, heat and friction increases at the interfaces between a developer roll and the seals which contact the developer roll and serve to prevent toner from escaping at the ends of the developer. Since toner is electrostatically held to the developer roll, the increased temperatures may melt the toner on the developer roll surface. The melted toner may cause toner leaks around the doctor blade and the lower developer seals. To address heating issues within the developer, prior attempts included introducing airflow in the location of the developer roll. With developers being largely removable from the imaging apparatus, challenges exist in providing proper mating between the developer and the imaging apparatus for effectively controlling airflow to the developer roll.

SUMMARY OF THE INVENTION

The above-mentioned and other challenges are addressed with a cooling system including an air distribution duct disposed in the developer of an imaging unit for distributing cooling air on a surface of the developer roll, and a connecting segment disposed in the imaging unit for connecting the air distribution duct to an air supply line in the imaging apparatus.

The connecting segment may include an air conduit having a first end insertably attached to and in fluid communication with the air distribution duct for channeling cooling air from the air supply line to the air distribution duct, and an air entry port disposed on a second end of the air conduit for slidably connecting to the air supply line during installation of the removable imaging unit in the imaging apparatus. A connecting surface of the air entry port may be angled inwardly towards a leading end of the imaging unit for mating with the air supply line. The connecting surface of the air entry port may be further angled inwardly towards a bottom side thereof. A seal material may substantially cover the air entry port. The seal material may be chamfered at a leading end thereof to allow initial clearance between the seal and the air supply line during initial installation of the imaging unit.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
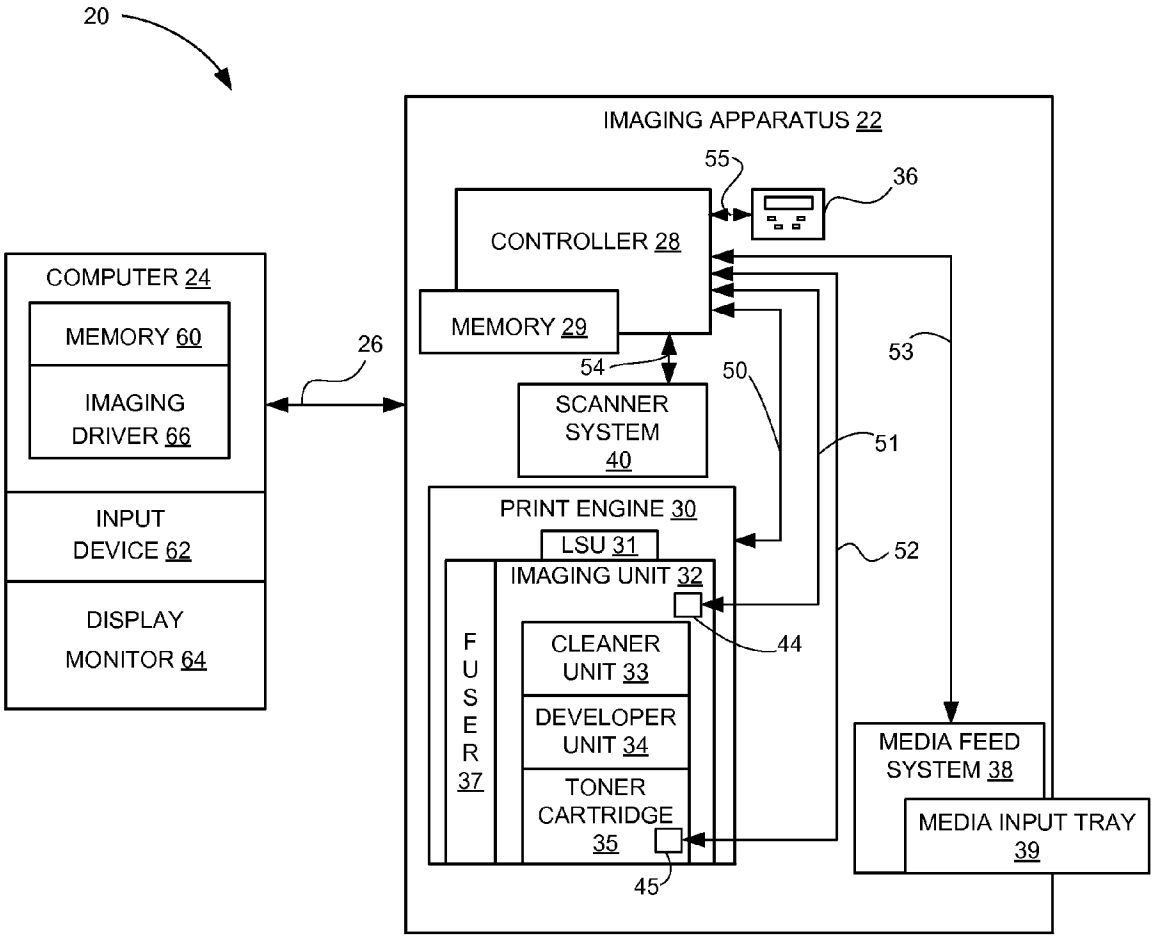
FIG. 1 is a block diagram of an example imaging system utilizing the imaging unit of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use herein of "including," "comprising," or "having" and variations thereof is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an imaging apparatus. The terms "left" and "right" are as viewed with respect to the insertion direction of a unit into the imaging apparatus. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The term "image", as used herein, encompasses any printed or digital form of text, graphic, or combination thereof. The term "output", as used herein, encompasses output from any printing device such as color and black-and-white copiers, color and black-and-white printers, and so-called "all-in-one devices" that incorporate multiple functions such as scanning, copying, and printing capabilities in one device. The term "button", as used herein, means any component, whether a physical component or graphic user interface icon, that is engaged to initiate output.

Referring now to the drawings and particularly to FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to structure that facilitates electronic communication between multiple components, and may operate using wired or wireless technology and may include communications over the Internet. Imaging system 20 may be, for example, a customer imaging system, or alternatively, a development tool used in imaging apparatus design.

In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39 and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40, or a standalone scanner system 40.

Controller 28 includes a processor unit and associated memory 29, and may be formed as one or more Application Specific Integrated Circuits (ASIC). Memory 29 may be, for example, random access memory (RAM), read only memory (ROM), and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 or toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, including memory 60, such as RAM, ROM, and/or NVRAM, an input device 62, such as a keyboard, and a display monitor 64. Computer 24 further includes a processor, input/output (I/O) interfaces, and may include at least one mass data storage device, such as a hard drive, a CD-ROM and/or a DVD unit.

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum, developer unit 34 and a toner cartridge 35 that are removably mounted within imaging unit 32. In one embodiment the cleaner unit 33 and developer unit 34 are assembled together and installed into a frame of the imaging unit 32. The toner cartridge 35 is then installed in the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
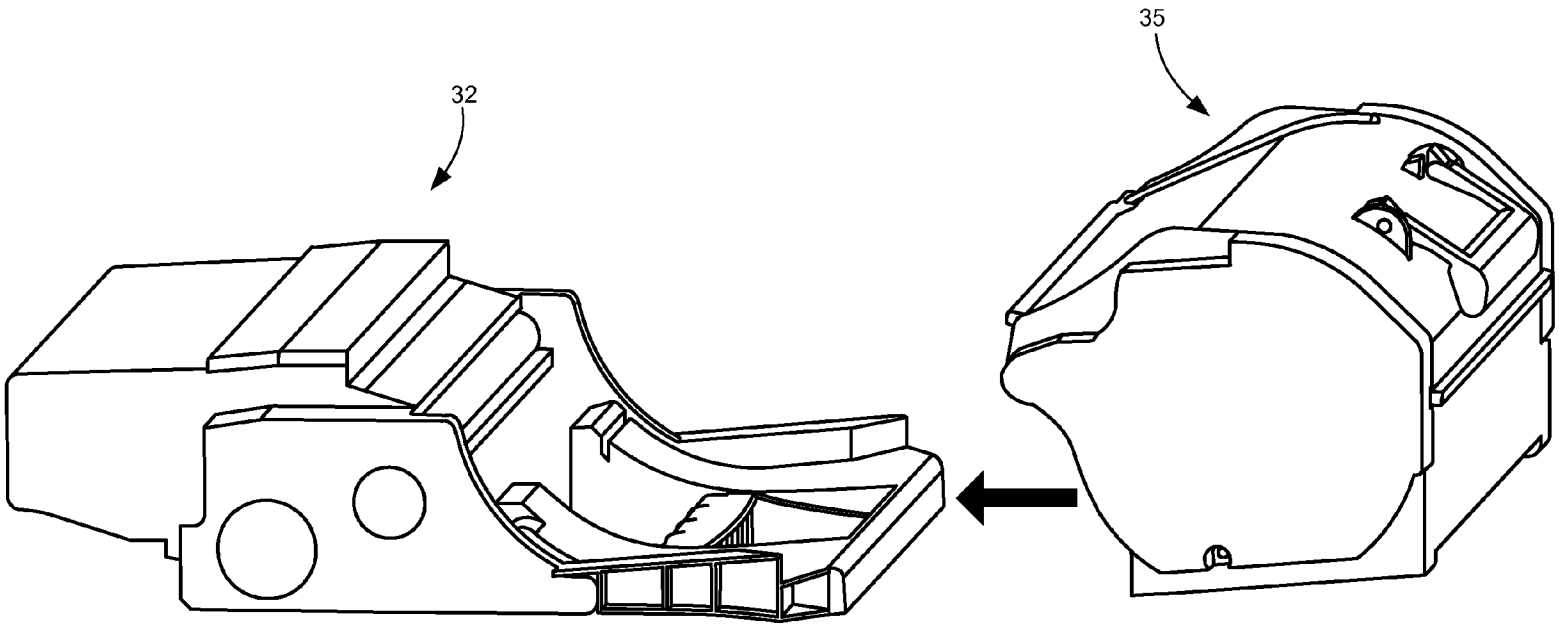
FIG. 2 is a view of the imaging unit and the toner cartridge.

FIG. 2 is a view of the imaging unit 32 and the toner cartridge 35. In one example embodiment of the present disclosure, toner cartridge 35 may be configured to removably mate with the developer unit 34 in the imaging unit 32 during installation into the imaging apparatus 22 (not shown). Of course the present disclosure may be capable of other embodiments independent of the configuration of the imaging unit 32 in relation to the toner cartridge 35.

As mentioned above, as the speed of printing devices increase, the temperature within the developer unit 34 of imaging unit 32 increases. To better control operating temperatures, developer unit 34 may include an air distribution system for introducing a flow of relatively cool air therein.

The air distribution system may direct airflow generally towards components within developer unit 34 which are believed to experience undesirable temperature levels during normal operation of imaging apparatus 22. The air distribution system of developer unit 34 is adapted to cooperate with an air supply line within imaging apparatus 22 when imaging unit 32 is in its operable position therein. The air supply line of imaging apparatus 22 may be in fluid communication with a fan internal to imaging apparatus 22, for creating airflow within the air supply line. The air supply line may distribute the generated airflow to other areas of imaging apparatus 22 which generate heat in addition to developer unit 34 of imaging apparatus 32.

Figure 3A:
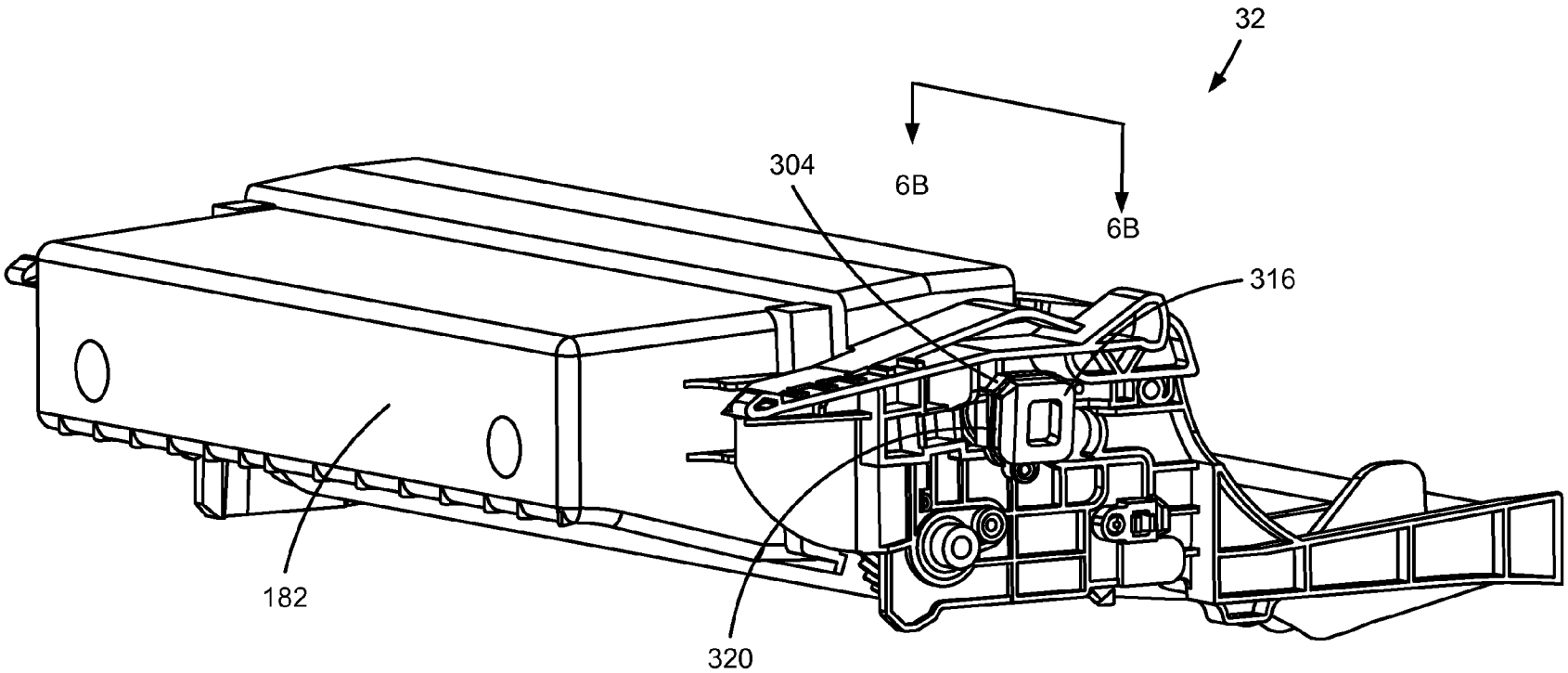
FIG. 3A is a perspective view depicting the imaging unit of FIG. 2.
Figure 3B:
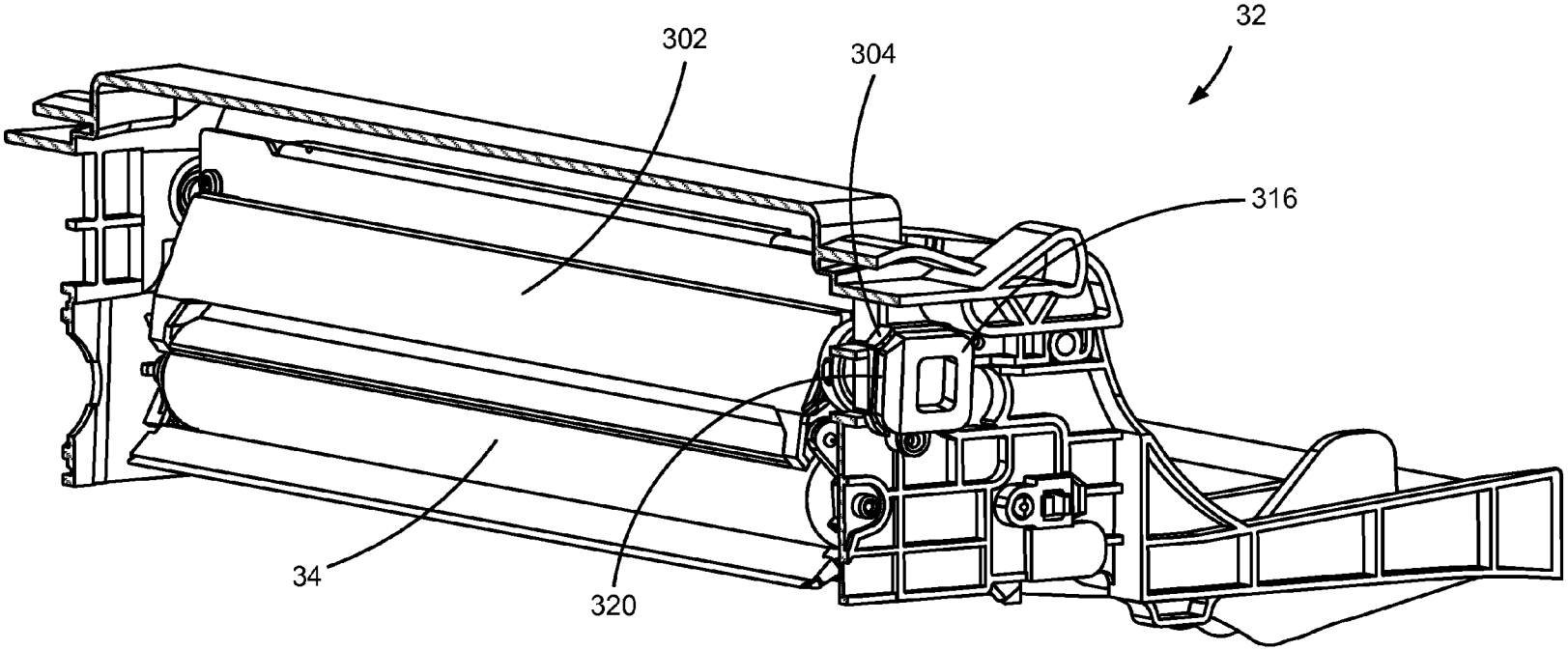
FIG. 3B is a cut-away perspective view of the imaging unit showing an air distribution duct and the developer unit thereof.

FIGS. 3A and 3B depict the imaging unit 32 with a view of the leading end 182 thereof. FIG. 3A shows the location of a seal 316 and corresponding connecting segment 304 in relation to the leading end 182 of the imaging unit 32. The seal 316 may be attached to the connecting segment 304 as may be shown in greater detail later in FIG. 4. The connecting segment 304 with the seal 316 may be disposed on a side of the imaging unit 32 to connect with an air supply line duct 400 as may be shown in detail in FIGS. 8A-8C.

The connecting segment 304 may be attached to the imaging unit 32 and may be connected to an air distribution duct 302 disposed in an upper portion of the developer unit 34 as shown on FIG. 3B. Cooling air entering through the seal 316 and the connecting segment 304 may be distributed to the developer unit 34 through the air distribution duct 302.

Figure 4:
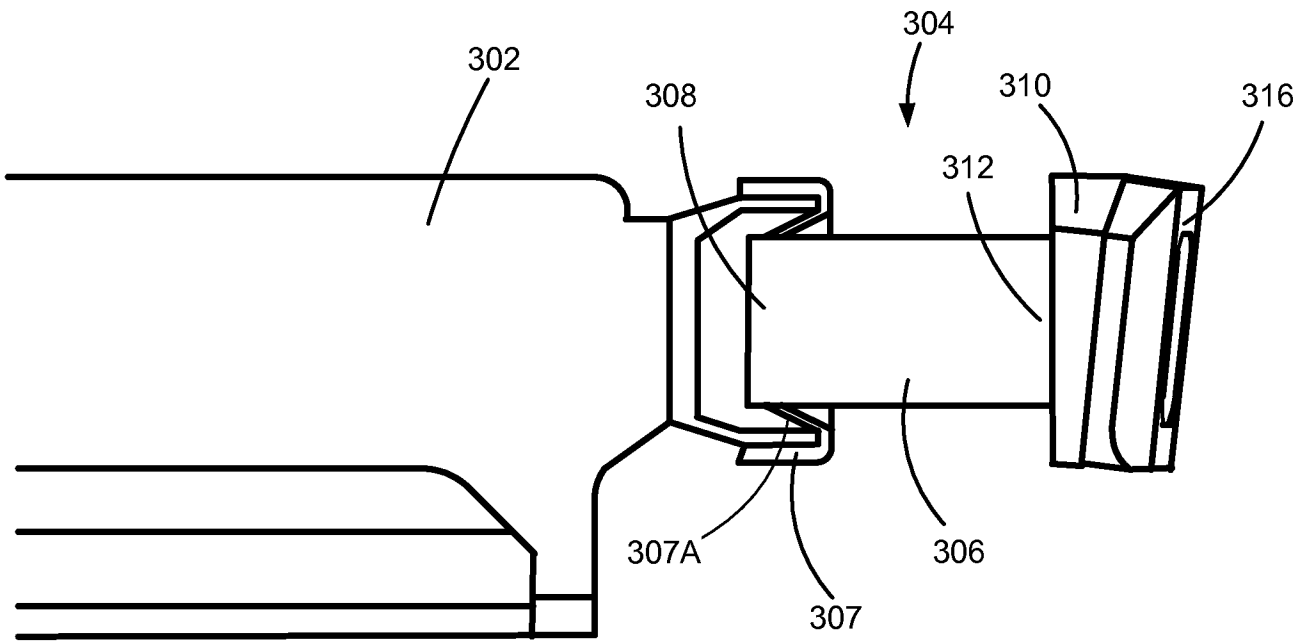
FIG. 4 is a side cross-sectional view depicting a connecting segment and the air distribution duct of the imaging unit of FIGS. 3A and 3B.

FIG. 4 depicts the seal 316, the connecting segment 304 and the air distribution duct 302 in an assembled position. The seal 316 may be attached to an air entry port 310 of the connecting segment 304. The connecting segment 304 may include an air conduit 306 having a first end 312 and a second end 308. In one example embodiment, the seal 316 may be removably attached to the air entry port 310 of the connecting segment 304 through use of an adhesive. Of course, the present disclosure is not limited by the manner of attaching the seal 316 to the connecting segment 304, and the seal 316 may be attached to the connecting segment 304 using other methods and mechanisms known in the art. The air entry port 310 may be attached to or integrally formed with the first end 312 of the air conduit 306. The second end 308 of the air conduit 306 may be inserted to a flexible seal 307 of the air distribution duct 302 to flexibly couple the connecting segment 304 to the air distribution duct 302. In particular, flexible seal 307 may include a substantially frustoconical shaped inner portion 307A into which second end 308 is slidingly inserted. When received in inner portion 307A of flexible seal 307, air conduit 306 forms a substantially flexible seal therewith. A benefit of the substantially flexible seal formed between flexible seal 307 and air conduit 306 is that the formed seal allows for movement of air distribution duct 302 and connecting segment 304 relative to each other without disrupting the seal formed therebetween.

Figure 5:
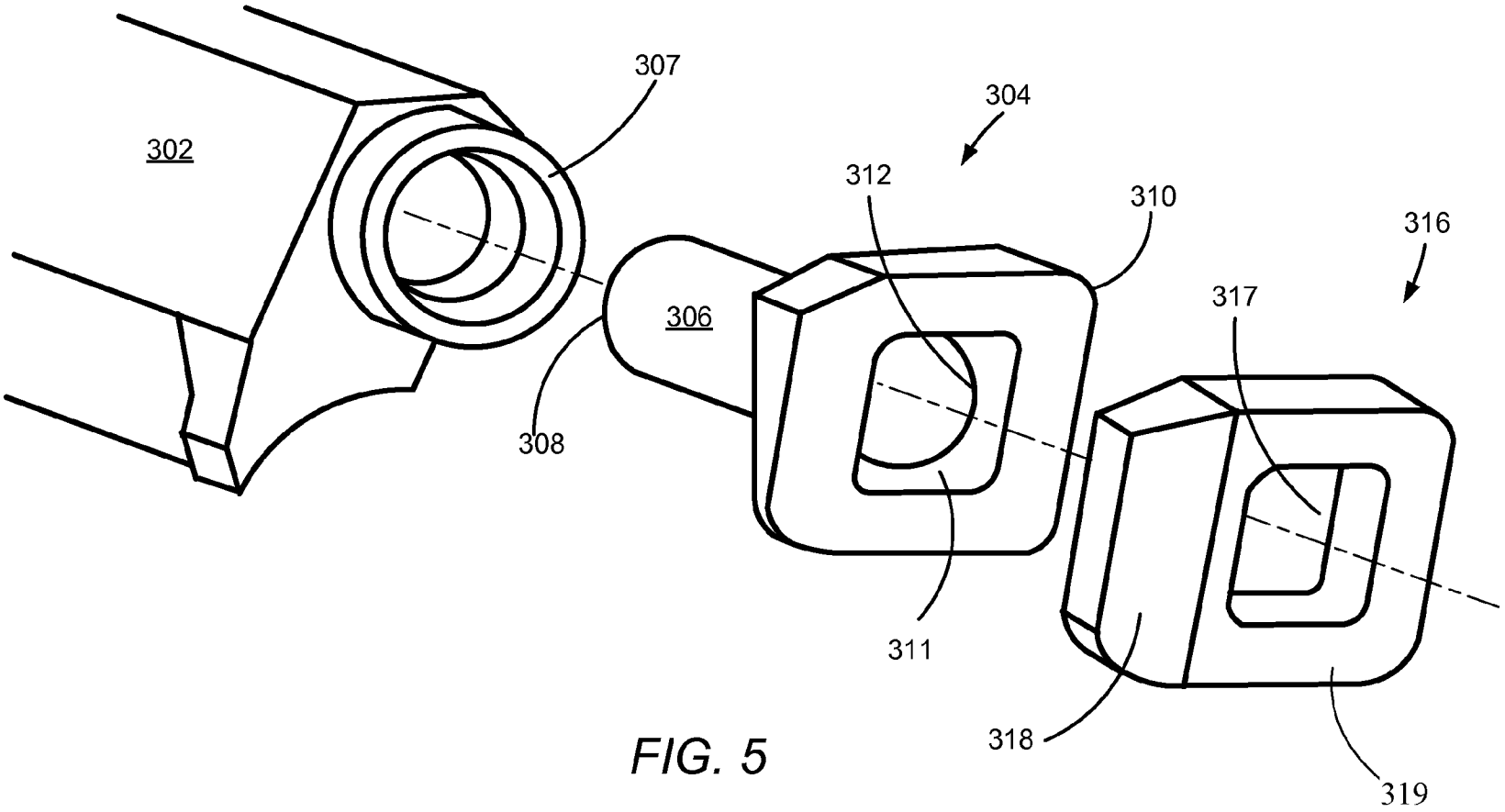
FIG. 5 is an exploded, perspective view of the connecting segment and the air distribution duct.

FIG. 5 is a view of the seal 316 in conjunction with the connecting segment 304 and the air distribution duct 302. The seal 316 may include an aperture 317 for allowing passage of cooling air. In the present example embodiment, the seal 316 may have a generally quadrilateral shaped outer surface portion 319. A leading side end portion of seal 316 may be chamfered 318 to facilitate robust, smooth, and convenient connection to the air supply line of imaging apparatus 22, as will be described in greater detail below. In the present example embodiment, an aperture 311 of the air entry port 310 may be aligned and in fluid communication with the aperture 317 of the seal 316. The air entry port 310 may be attached to or integrally formed with the first end 312 of the air conduit 306 such that cooling air entering the aperture 311 of the air entry port 310 may be received by the air conduit 306 and conveyed towards the air distribution duct 302. The air conduit 306 in the present example embodiment may be cylindrical in shape but alternatively may have different shapes.

Figure 6A:
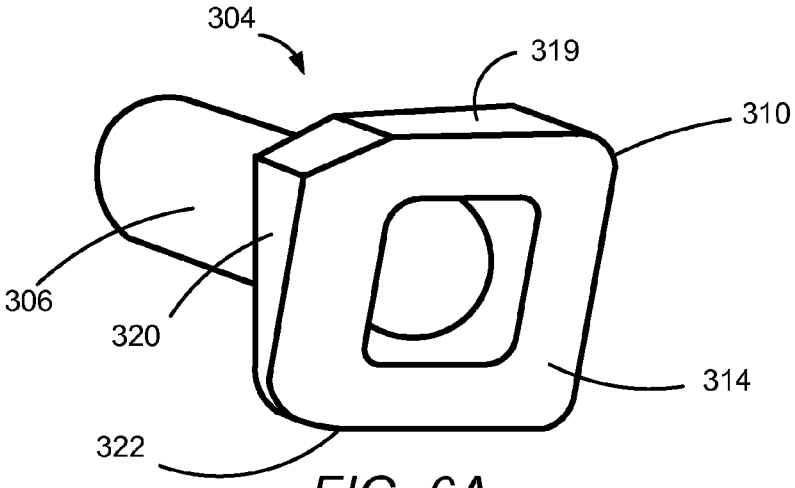
FIGS. 6A, 6B and 6C are side and perspective views depicting in detail the different parts of the connecting segment.
Figure 6B:
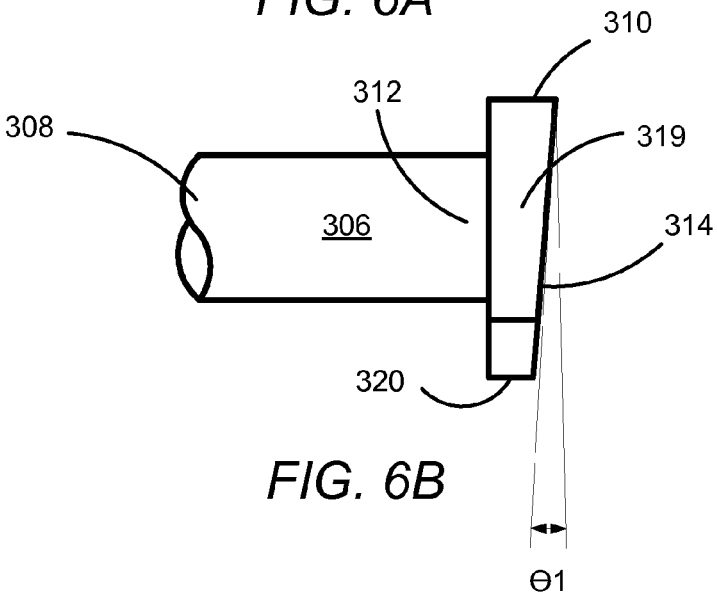
Figure 6C:
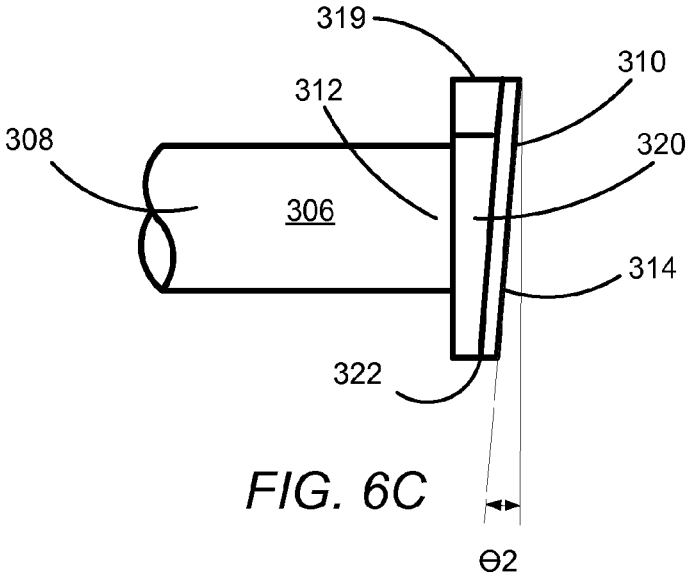

FIGS. 6A, 6B and 6C depict features of the connecting segment 304. FIG. 6A shows the major components of the connecting segment 304—the air entry port 310 and the air conduit 306. The air entry port 310 having a top side 319, a leading side 320 and a bottom side 322 may include a connecting surface 314 configured to connect to or otherwise be formed with the seal 316. FIG. 6B is a top view of the connecting segment 304 taken along line 6B-6B in FIG. 3A and shows the connecting surface 314 angled inwardly toward leading side 320. Angle $\Theta$1 may be configured to allow easier installation of the connecting segment 304 which will be described below with respect to FIGS. 8A-8C. In one example embodiment, angle $\Theta$1 may be between about five degrees and about six degrees and in particular may be 5.94 degrees. Angle $\Theta$1 may also be viewed as an angle of the connecting surface 314 relative to a plane extending laterally through air conduit 306, or a plane extending perpendicular to a longitudinal axis of air conduit 306. FIG. 6C is a front elevational view from the leading end 182 of the imaging unit 32 and shows the connecting surface 314 further angled inwardly toward the bottom side 322 at an angle $\Theta$2. Angle $\Theta$2 may also be viewed as an angle of the connecting surface 314 relative to the plane extending laterally through air conduit 306 and/or extending perpendicular to a longitudinal axis of air conduit 306. Angle $\Theta$2 may be configured to allow better alignment between the connecting segment 304 and the air supply line duct 400 as will be shown later in FIGS. 8A and 8B. In one example embodiment, angle $\Theta$2 may be between about six degrees and about seven degrees and in particular may be 6.37 degrees. As can be seen, connecting surface 314 is angled inwardly at angles $\Theta$1 and $\Theta$2 in directions that are orthogonal to each other. It is understood that angles $\Theta$1 and $\Theta$2 may vary from the range of angles described above. For example, each of angles $\Theta$1 and $\Theta$2 may be between about four and about eight degrees.

Figure 7A:
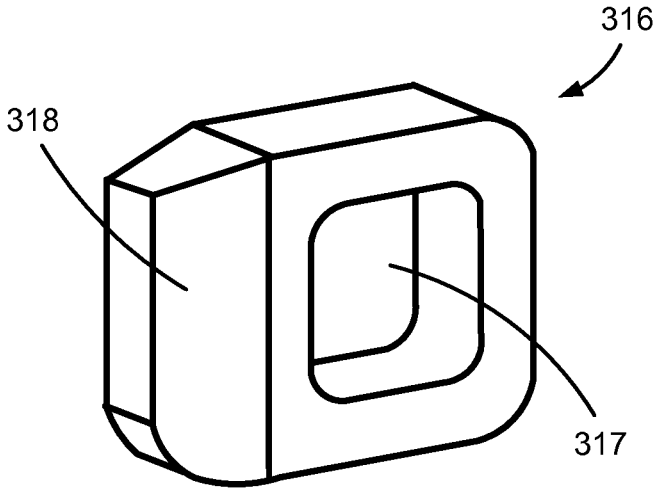
FIGS. 7A and 7B are perspective and top plan views, respectively, depicting a seal of the connecting segment.
Figure 7B:
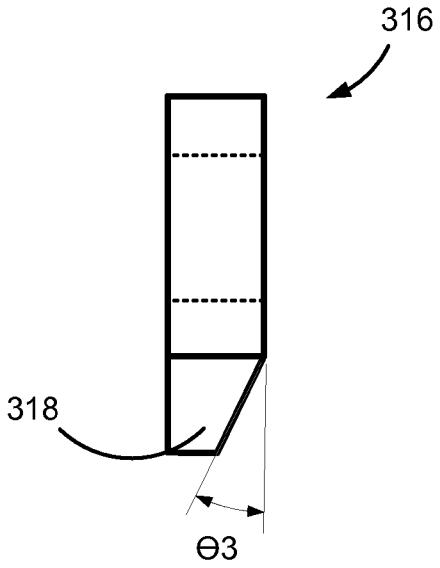

FIGS. 7A and 7B depict features of the seal 316. The chamfered leading end portion 318 may provide initial clearance between the seal 316 and the air supply line duct 400 during installation. FIG. 7B is a top view of the seal 316, taken along line 6B-6B in FIG. 3B, showing the leading end portion 318 chamfered by angle $\Theta$3. In one example embodiment, the angle $\Theta$3 of the chamfer is between about 34 and about 35 degrees, such as 34.85 degrees. The seal 316 may be made of a compressible material, such as but not limited to a foam material, to allow compression and tight connection between the connecting segment 304 and the air supply line duct 400. In an example embodiment, the seal 316 may be covered with a protective film to protect the seal 316 from tearing during repeated instances of mating with the air supply line duct 400.

Figure 8A:
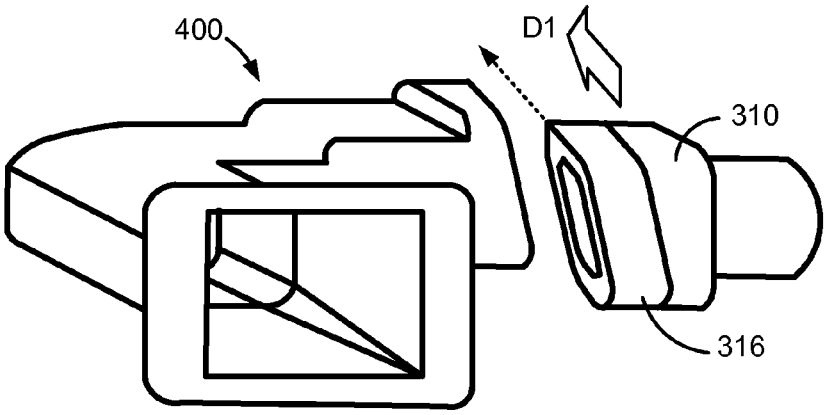
FIGS. 8A, 8B and 8C are views depicting the mating of the connecting segment to the air supply line duct of an imaging apparatus during installation of the imaging unit.
Figure 8B:
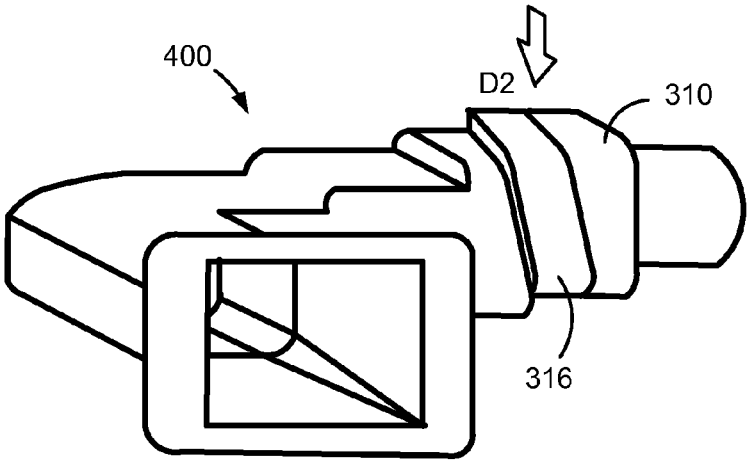
Figure 8C:
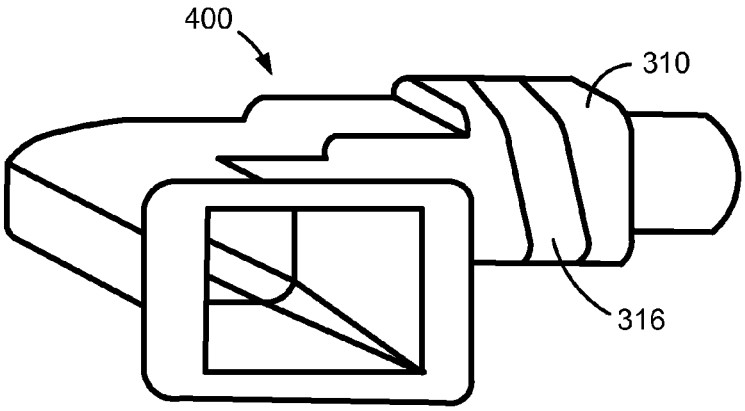

FIGS. 8A, 8B and 8C depict the establishment of an airflow path between developer unit 34 and air supply line duct 400 during installation of imaging unit 32 into imaging apparatus 22. The air supply line duct 400 may be disposed in the imaging apparatus 22 in a fixed position while the connecting segment 304 with the seal 316 extending therefrom form part of imaging unit 32 as shown in FIGS. 3A and 3B.

FIG. 8A shows an initial stage of imaging unit insertion. As imaging unit 32 is inserted into the imaging apparatus 22 in direction D1, the connecting segment 304 with the seal 316 may be initially positioned at a slightly elevated position compared to the air supply line duct 400 which provides an amount of clearance due to the angled orientation of air entry port 310 and the chamfered leading end portion 318 as described above. The initial clearance may result in less contact between the seal 316 and the air supply line duct 400 during installation and may improve the life of the seal 316.

FIG. 8B shows the positioning of connecting segment 304 being substantially vertically aligned with the air supply line duct 400 but at a slightly higher elevation. At this point, the imaging unit 32 (connecting segment 304) is subsequently seated downwardly in direction D2 into place against air supply line duct 400 and creates a substantially sealed path for the flow of air to developer unit 34. FIG. 8C shows the connecting segment 304 with the seal 316 substantially fully aligned with the air supply line duct 400. Cooling air may now traverse from the air supply line duct 400 to the air distribution duct 302 through the seal 316 and the connecting segment 304.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A developer unit for an imaging apparatus, comprising:
a cooling system including,
an air distribution duct for distributing air in proximity with a surface in the developer unit; and
a connecting segment for connecting the air distribution duct to an air supply line of the imaging apparatus, the connecting segment including,
an air conduit having a first end insertably attached to the air distribution duct for channeling air from the air supply line to the air distribution duct; and
an air entry port disposed on a second end of the air conduit for slidably connecting to and mating with the air supply line during installation of the developer unit in the imaging apparatus, wherein a connecting surface of the air entry port is angled inwardly towards a leading insertion end of the developer unit.

2. The developer unit of claim 1, further comprising a seal substantially covering the connecting surface of the air e entry port.

3. The developer unit of claim 2, wherein the seal is chamfered at a leading end thereof to allow clearance between the seal and the air supply line during initial installation of the developer unit.

4. The developer unit of claim 3, wherein an angle of the chamfered end is about 35 degrees.

5. The developer unit of claim 2, wherein the seal is covered with a protective film.

6. The developer unit of claim 1, wherein the connecting surface of the air entry port is angled inwardly towards the leading insertion end of the developer unit between about five and about six degrees.

7. The developer unit of claim 1, wherein the connecting surface of the air entry port is further angled inwardly from a top side to a bottom side of the developer unit.

8. A cooling system for a removable unit of an imaging apparatus, comprising:
an air distribution duct disposed on the removable unit for distributing cooling therein; and
a connecting segment disposed on the removable unit for connecting the air distribution duct to an air supply line of the imaging apparatus, the connecting segment including
an air entry port extending from a side of the removable unit, coupled to the air distribution duct and having a connecting surface for slidably connecting to the air supply line during installation of the removable unit, wherein the connecting surface of the air entry port is angled inwardly in at least one direction along the side of the removable unit.

9. The cooling system of claim 8, further comprising a seal material substantially covering the connecting surface of the air entry port.

10. The cooling system of claim 9, wherein the seal material is chamfered at a leading end thereof to allow clearance during initial installation of the removable unit.

11. The cooling system of claim 10, wherein the chamfered seal material includes a chamfered surface angled between about six and about seven degrees relative to an outwardly facing surface of the seal material.

12. The cooling system of claim 9, wherein the seal material is covered with a protective film.

13. The cooling system of claim 8, wherein the connecting surface of the air entry port is angled between about four and about eight degrees in the at least one direction.

14. The cooling system of claim 8, wherein the connecting surface of the air entry port is further angled in a second direction along the side of the removable unit.

15. A connector for a cooling system of a removable unit of an imaging apparatus, comprising:
an air conduit for channeling air therethrough; and
an air entry port disposed on an end of the air conduit and having a connecting surface that is angled inwardly in a first direction relative to a plane extending laterally through the air conduit and further angled inwardly in a second direction substantially orthogonal to the first direction.

16. The connector of claim 15, further comprising a foam seal substantially covering the connecting surface of the air entry port.

17. The connector of claim 16, wherein the foam seal is chamfered at an end thereof.

18. The connecting segment of claim 16, wherein the foam seal is covered with a protective film.

19. The connector of claim 15, wherein the connecting surface of the air entry port is angled in the first direction between about four degrees and about eight degrees.

20. A connector for a cooling system of a removable unit of an imaging apparatus, comprising:
an air conduit for channeling air therethrough;
an air entry port disposed on an end of the air conduit and having a connecting surface that is angled inwardly in a direction relative to a plane extending laterally through the air conduit;and
a foam seal substantially covering the connecting surface of the air entry port,
wherein the foam seal is chamfered at an end thereof.

* * * * *